US005699928A

United States Patent [19]

Chung et al.

[11] Patent Number: 5,699,928

[45] Date of Patent: Dec. 23, 1997

[54] EASY FLIP TOP TAB LIFTER

[76] Inventors: Sung I. Chung; Katalina Park, both of 360 S. Burnside Ave., Apt. #2K, Los Angeles, Calif. 90036

[21] Appl. No.: 669,135

[22] Filed: Jun. 24, 1996

[51] Int. Cl.[6] ..... B65D 17/36

[52] U.S. Cl. ..... 220/269; 220/270; 220/906; 81/3.15; 81/3.4; 81/3.55; 81/3.57; 16/110 R

[58] Field of Search ..... 220/269, 270, 220/906, 284, 285, 755, 756, 759, 768, 751; 215/386, 390, 396, 398, 399; 81/3.07, 3.15, 3.27, 3.35, 3.4, 3.41, 3.43, 3.55, 3.57; 16/110 R; 383/11, 14, 25–27; 229/117.23, 160.2

[56] References Cited

U.S. PATENT DOCUMENTS

| | | | |
|---|---|---|---|
| 714,816 | 12/1902 | McMullan | 229/160.2 X |
| 1,718,298 | 6/1929 | Markman | 383/25 |
| 2,846,134 | 8/1958 | Moubayed | 383/25 X |
| 3,115,294 | 12/1963 | Gatward | 383/26 X |
| 3,383,029 | 5/1968 | Reade | 229/117.23 |
| 3,556,186 | 1/1971 | Besthorne | 383/25 X |
| 3,567,108 | 3/1971 | Corridon | 229/117.23 |
| 4,119,268 | 10/1978 | Segura | 383/25 X |
| 4,133,228 | 1/1979 | DePooter . | |
| 4,253,352 | 3/1981 | O'Neal . | |
| 4,563,919 | 1/1986 | Sellars . | |
| 4,874,126 | 10/1989 | Miller | 229/160.2 |
| 5,092,481 | 3/1992 | Skelton | 220/756 X |
| 5,205,194 | 4/1993 | Rodey . | |
| 5,255,414 | 10/1993 | March | 16/110 R X |
| 5,257,566 | 11/1993 | Schultz | 81/3.55 |
| 5,329,832 | 7/1994 | Tegethoff | 81/3.41 X |

*Primary Examiner*—Allan N. Shoap
*Assistant Examiner*—Nathan Newhouse
*Attorney, Agent, or Firm*—Eugene Oak, Ph.D., J.D.

[57] ABSTRACT

The present invention is a disposable device which is attached to the tab of a conventional aluminum beverage can at the time of manufacture. When a consumer pulls the device upward, the tab is likewise pulled upward to a position in which the consumer can easily grasp the tab and consequently open the can. Two embodiments of the present invention are provided.

8 Claims, 6 Drawing Sheets

EASY FLIP TOP TAB LIFTER

BACKGROUND OF THE INVENTION

1. Field of the Invention

The present invention relates generally to a device for lifting the tab of a conventional aluminum beverage can, particularly to a disposable device which is attached at the time of manufacture.

2. Description of the Prior Art

Numerous devices have been developed with the purpose of aiding a consumer in opening canned beverages. Accordingly, the following registered patents are functionally similar to the present invention. U.S. Pat. No. 5,257,566 to Schultz is a thumb fitting, ring-like, flip-top can opening apparatus and method of using. U.S. Pat. No. 4,253,352 to O'Neal is a tool for opening cans. U.S. Pat. No. 4,133,228 to DePooter is a pull tab opener. U.S. Pat. No. 4,563,919 to Sellars is a can opener for flip top cans. U.S. Pat. No. 5,205,194 to Rodey is a can opener apparatus.

Although these inventions are similar in function to the present invention, the present invention possesses distinct advantages over the prior art which will be pointed out in more particularity later.

SUMMARY OF THE INVENTION

The present invention is a device which is attached to the tab of a conventional aluminum beverage can. When a consumer pulls the device upward, the tab is indirectly pulled upward to a position in which the consumer can easily grasp the tab and consequently open the can.

Thus, a primary object of the present invention is to provide a device which aids a consumer in opening a conventional aluminum beverage can.

Another object of the present invention is to provide device which is attached to a can at the time of manufacture.

Another object of the present invention is to provide a device which is disposable.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

For a better understanding of the nature of the present invention, reference should be made to the following detailed description taken in connection with the accompanying drawings wherein.

DETAILED DESCRIPTION OF THE DRAWINGS

Figure 1A:
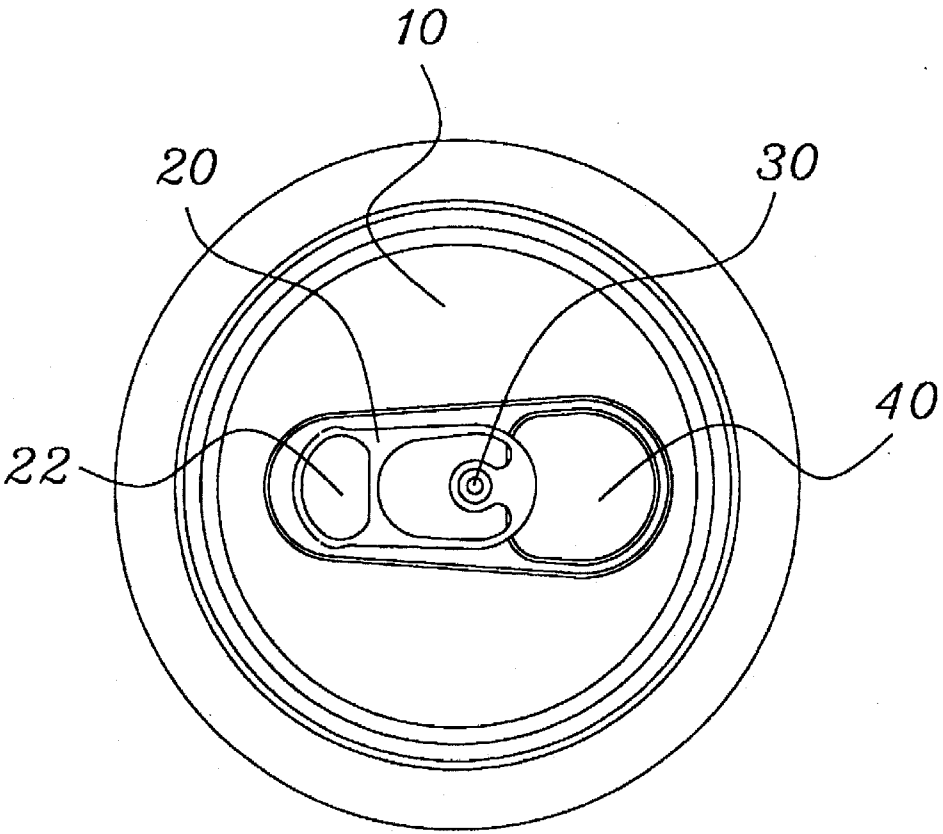
FIG. 1*a* is a top plan view of a conventional aluminum beverage can.

Referring now to FIG. 1*a*, the top of a convention aluminum beverage can comprises a circular surface 10, a tab 20, a pivot 30, and a pre-cut, depressible portion 40. The end of the tab 20 furthest from the pre-cut portion 40 has a hole 22 therethrough. A consumer conventionally utilizes this opening system by pulling upward on the end of the tab 20 furthest from the pre-cut portion 40. As the portion of the tab 20 to the left of the pivot 30 moves upward, the portion of the tab 20 to the right of the pivot 30 correspondingly moves downward. The pre-cut portion 40 is thereby depressed and the contents of the can made accessible.

Figure 1B:
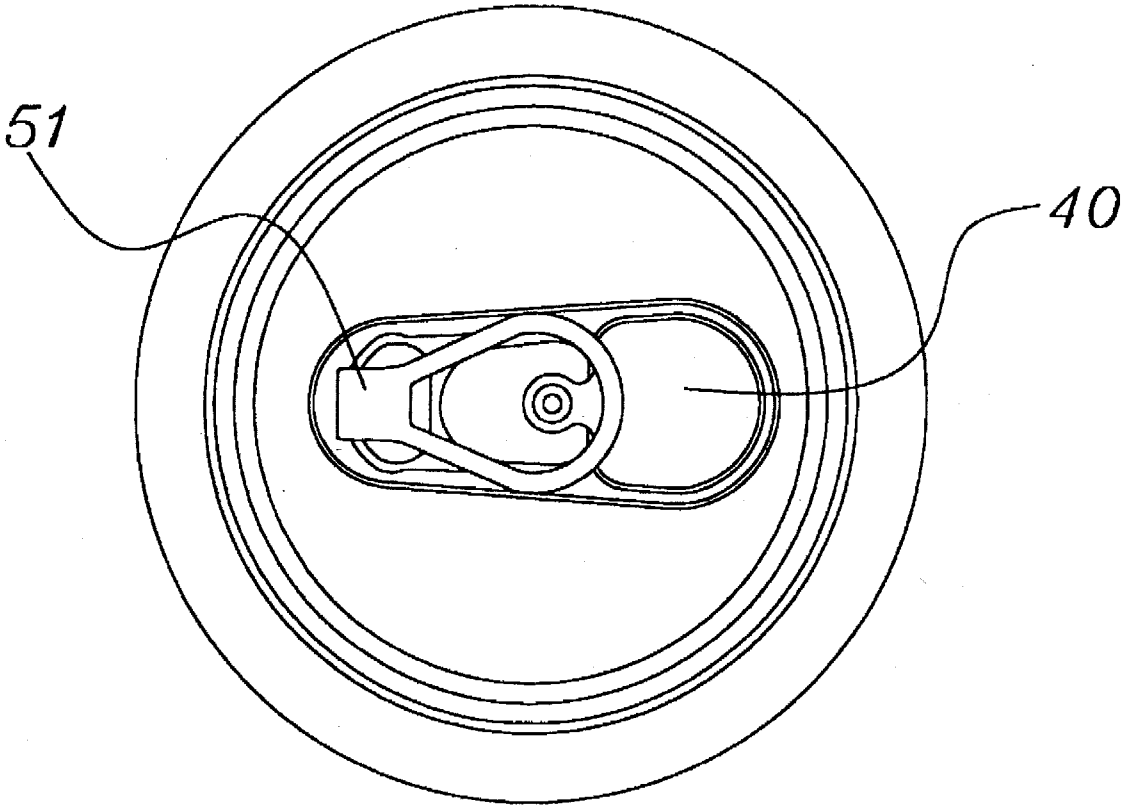
FIG. 1*b* is a top plan view of a conventional aluminum beverage can with a first embodiment of the present invention attached.
Figure 1C:
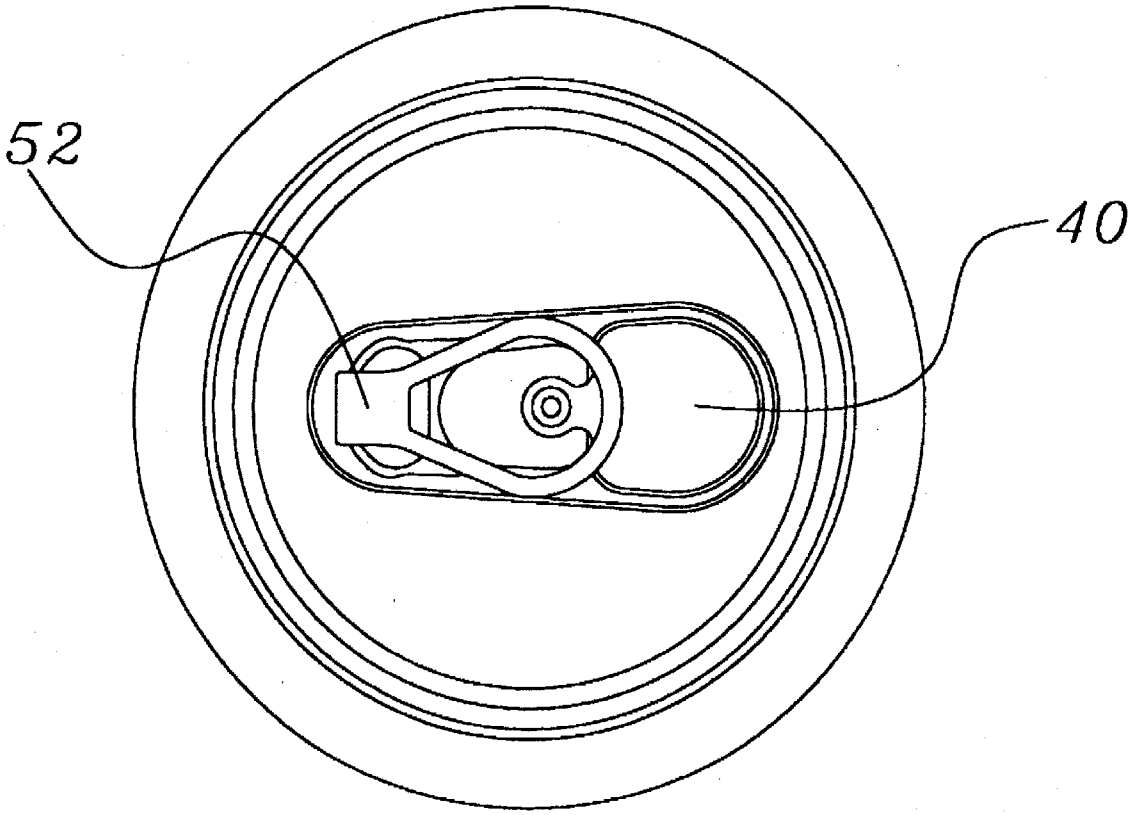
FIG. 1*c* is a top plan view of a conventional aluminum beverage can with a second embodiment of the present invention attached.

In FIG. 1*b*, a first embodiment 51 of the present invention is movably attached to the end of the tab 20 furthest from the precut portion 40. In FIG. 1*c*, a second embodiment 52 of the present invention is moveably attached to the end of the tab 20 furthest from the precut portion 40.

Figure 2B:
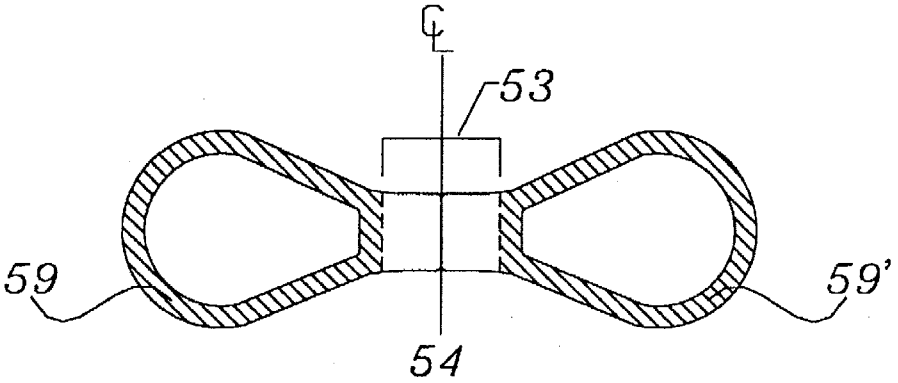
FIG. 2*b* is a top plan view of a second embodiment of the present invention before it is attached to a can.
Figure 2A:
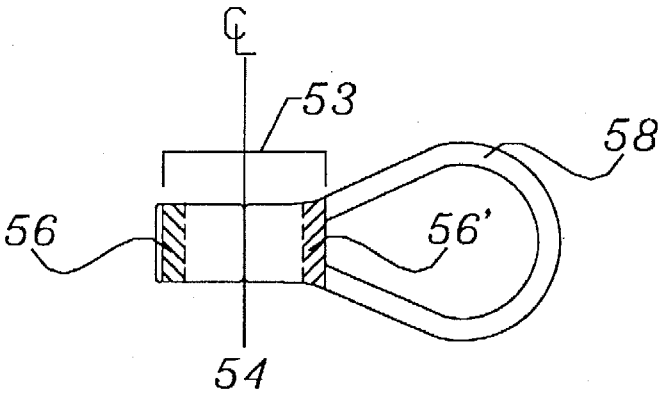
FIG. 2*a* is a top plan view of a first embodiment of the present invention before it is attached to a can.
Figure 2E:
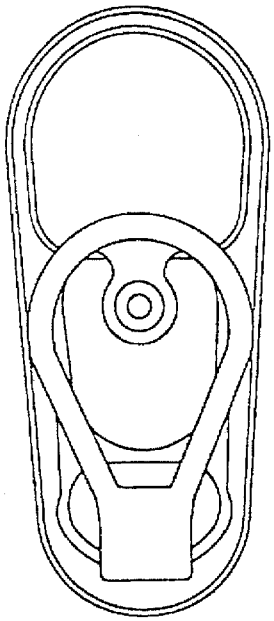
FIG. 2E is an enlarged top plan view of a conventional aluminum beverage can with the present invention affixed thereto.
Figure 2D:
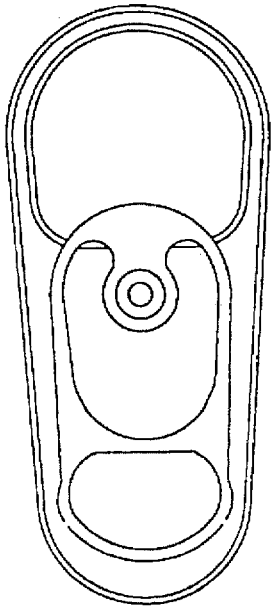
FIG. 2D is an enlarged top plan view of a conventional aluminum beverage can.

Referring now to FIG. 2*a*, a first embodiment 51 of the present invention particularly comprises a link portion 53 and a ring portion 58 which extends from one side of the link portion 53. An adhesive strip 56 at one end of one side of the link portion 53 corresponds to another adhesive strip 56' at the other end of the same side of the link portion 53. Thus, after the link portion 53 has been inserted through the hole 22 in a tab 20, the adhesive strip 56 is bent over 180 degrees across an implied line of symmetry 54 to fully contact its corresponding adhesive strip 56', thereby attaching the present invention to the tab 20. Although adhesives are used for illustrative purposes, a heat press or other method of joining materials may be substituted.

Referring now to FIG. 2*b*, a second embodiment 52 of the present invention also comprises a link portion 53. However, this embodiment has a ring portion 59 and 59' extending from either side of the link portion 53. Both of these ring portions 59 and 59' have adhesive applied to one entire side. Thus, after one ring portion 59 has been inserted through the hole 22 in a tab 20, the ring portion 59 is bent over 180 degrees across an implied line of symmetry 54 to fully contact the other ring portion 59', thereby attaching the present invention to the tab 20. Again, a heat press or other method of joining materials may be substituted for adhesives.

Figure 2C:
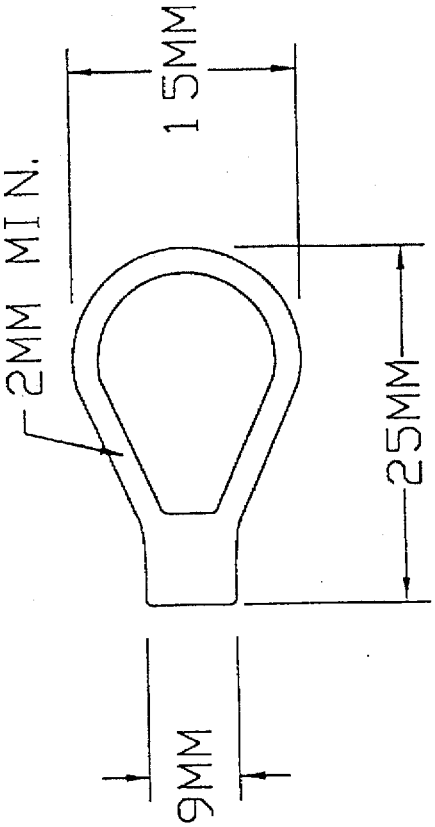
FIG. 2*c* is a top plan view of the present invention showing the preferred dimensions for the device.

Referring now to FIG. 2*c*, preferred dimensions for both embodiments of the present invention are shown. However, these dimensions are preferences only and may be modified as the need arises.

Figure 3B:
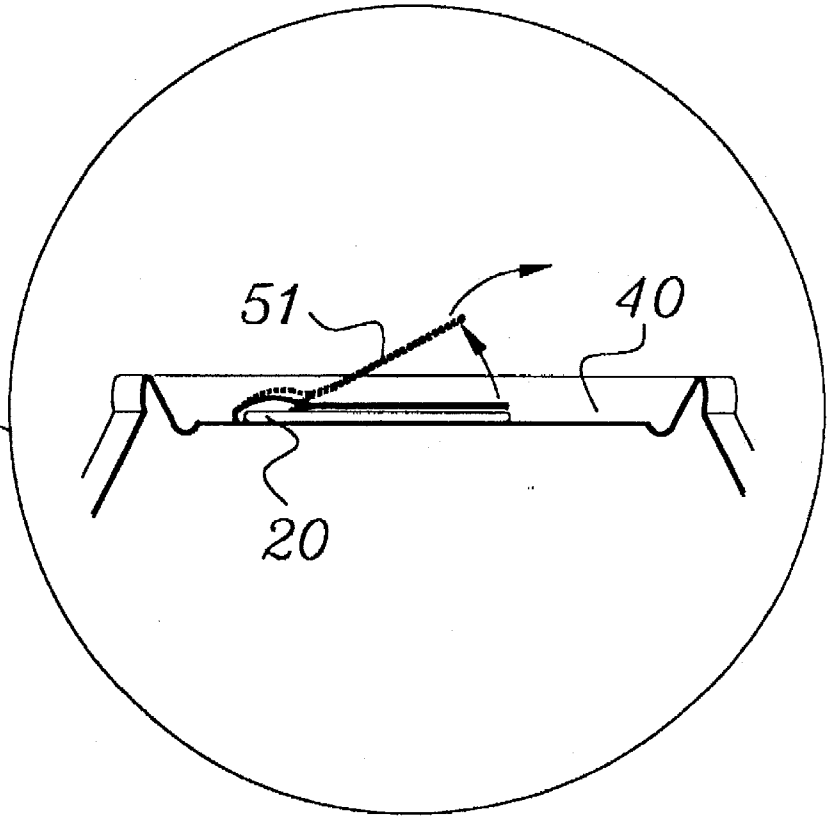
FIG. 3*b* is an exploded view of the encircled portion in FIG. 3*a*.
Figure 3A:
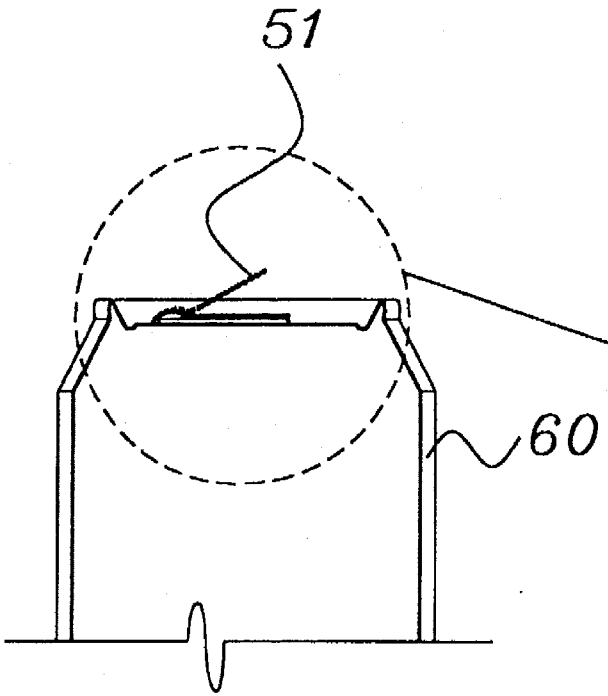
FIG. 3*a* is a fragmented cross-sectional side elevational view of the present invention attached to a can.

Referring now to FIGS. 3*a* and 3*b*, the present invention 51 (52) is shown attached to a conventional aluminum can. As the present invention 51 (52) is pulled upward, the tab 20 is indirectly pulled upward, thereby depressing the pre-cut portion 40 and making the contents of the can accessible.

I claim:

1. A device for assisting the opening of a can having a pivoting tab with an aperture therethrough for opening a tear panel, said device being composed of malleable plastic and comprising:

a. a flat, rectangular portion;

b. an adhesive strip along one edge of one surface of said rectangular portion;

c. a corresponding adhesive strip along an opposite edge of the same surface of said rectangular portion;

d. a flat ring portion extending from said one edge of said rectangular portion having said adhesive strip applied thereto;

e. said flat, rectangular portion defining a looping means for attaching said device to said pivoting tab, wherein said rectangular portion is of a size that said rectangular portion is foldable into two opposing portions and looped through said aperture of said pivoting tab and secured thereto by said adhesive strips.

2. The device as in claim 1 wherein said device is composed of aluminum.

3. The device as in claim 1 wherein said device is composed of thin metal.

4. The device as in claim 1 wherein a heat press is used in place of said adhesive strips.

5. A device for assisting the opening of a can having a pivoting tab with an aperture therethrough for opening a tear panel, said device being composed of malleable plastic and comprising:

a. a flat, rectangular portion having two pairs of opposing edges;

b. a flat ring portion extending from each opposing edge of one said pair of opposing edges of said rectangular portion;

c. adhesive material applied to a top surface of said first ring and to a top surface of said second ring;

d. said flat, rectangular portion defining a looping means for attaching said device to said pivoting tab, wherein said rectangular portion is of a size that said rectangular portion is foldable into two opposing portions and looped through said aperture of said pivoting tab and said ring portions overlie one another and are secured together by said adhesive material on said ring portions.

6. The device as in claim 5 wherein said device is composed of aluminum.

7. The device as in claim 5 wherein said device is composed of thin metal.

8. The device as in claim 5 wherein a heat press is used in place of said adhesive material.

* * * * *